US010823357B2

(12) United States Patent
Courcier et al.

(10) Patent No.: US 10,823,357 B2
(45) Date of Patent: Nov. 3, 2020

(54) LUMINOUS MODULE INCLUDING A FIELD-CORRECTING OPTICAL ELEMENT

(71) Applicant: VALEO VISION, Bobigny (FR)

(72) Inventors: Marine Courcier, Unterfoehring (DE); Alexandre Joerg, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/023,696

(22) Filed: Jun. 29, 2018

(65) Prior Publication Data

US 2019/0003674 A1 Jan. 3, 2019

(30) Foreign Application Priority Data

Jun. 29, 2017 (FR) ..... 17 56064

(51) Int. Cl.

| | |
|---|---|
| ***F21S 41/275*** | (2018.01) |
| ***F21S 41/153*** | (2018.01) |
| ***F21S 41/25*** | (2018.01) |
| ***F21S 41/255*** | (2018.01) |
| ***F21S 43/14*** | (2018.01) |
| ***F21S 41/663*** | (2018.01) |
| ***F21S 41/151*** | (2018.01) |

(Continued)

(52) U.S. Cl.

CPC ..... *F21S 41/275* (2018.01); *F21S 41/141* (2018.01); *F21S 41/151* (2018.01); *F21S 41/153* (2018.01); *F21S 41/24* (2018.01); *F21S 41/25* (2018.01); *F21S 41/255* (2018.01); *F21S 41/663* (2018.01); *F21S 43/14* (2018.01); *F21W 2102/14* (2018.01); *F21Y 2105/14* (2016.08); *F21Y 2115/10* (2016.08)

(58) Field of Classification Search

CPC ..... F21S 41/275; F21S 41/285; F21S 41/40; F21V 13/00

See application file for complete search history.

(56) References Cited

U.S. PATENT DOCUMENTS

2006/0176695 A1* 8/2006 Gordin ..... H05B 41/392 362/263
2010/0134866 A1* 6/2010 Foller ..... G03B 9/02 359/275

(Continued)

FOREIGN PATENT DOCUMENTS

DE 10 2008 061 556 A1 9/2009
EP 2 871 406 A1 5/2015

(Continued)

OTHER PUBLICATIONS

Machine translation of EP2979926 (Year: 2016).*

(Continued)

*Primary Examiner* — Leah Simone Macchiarolo
(74) *Attorney, Agent, or Firm* — Oblon, McClelland, Maier & Neustadt, L.L.P.

(57) ABSTRACT

A field-correcting optical element configured to be arranged in an adaptive lighting device crosswise to light rays emitted by a plurality of light sources includes an entrance face through which light rays enter and an exit face through which these light rays exit. At least one segment of the entrance face is covered with an antireflection coating that is able to increase the transmittance of light rays through the optical element.

5 Claims, 2 Drawing Sheets

(51) Int. Cl.

| | |
|---|---|
| ***F21S 41/24*** | (2018.01) |
| ***F21S 41/141*** | (2018.01) |
| *F21W 102/14* | (2018.01) |
| *F21Y 105/14* | (2016.01) |
| *F21Y 115/10* | (2016.01) |

(56) References Cited

U.S. PATENT DOCUMENTS

| | | | |
|---|---|---|---|
| 2013/0208493 | A1 | 8/2013 | Kloos |
| 2015/0131305 | A1 | 5/2015 | Courcier et al. |
| 2016/0341386 | A1 | 11/2016 | Iha et al. |
| 2017/0089536 | A1 | 3/2017 | Courcier et al. |
| 2018/0087736 | A1 | 3/2018 | Joerg et al. |
| 2018/0128443 | A1 | 5/2018 | Taudt et al. |

FOREIGN PATENT DOCUMENTS

| | | | |
|---|---|---|---|
| EP | 2 979 926 | A1 | 2/2016 |
| EP | 3 147 557 | A1 | 3/2017 |
| EP | 3 301 349 | A1 | 4/2018 |
| WO | WO 2014/087035 | A1 | 6/2014 |
| WO | WO 2017/015684 | A1 | 2/2017 |

OTHER PUBLICATIONS

French Preliminary Search Report dated May 17, 2018 in French Application 17 56064 filed on Jun. 29, 2017 (with English Translation of Categories of Cited Documents).

* cited by examiner

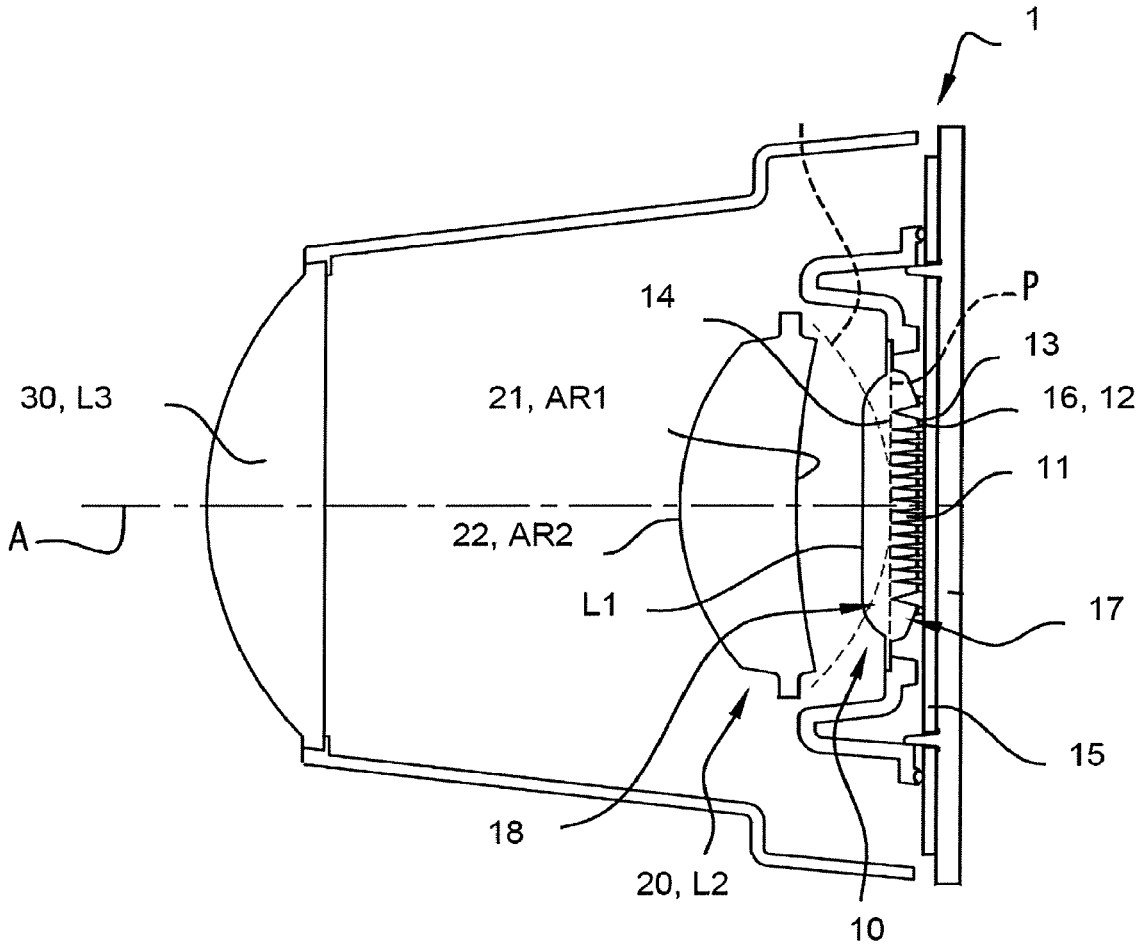
Fig. 1
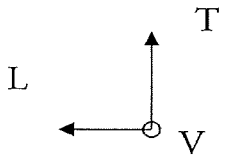

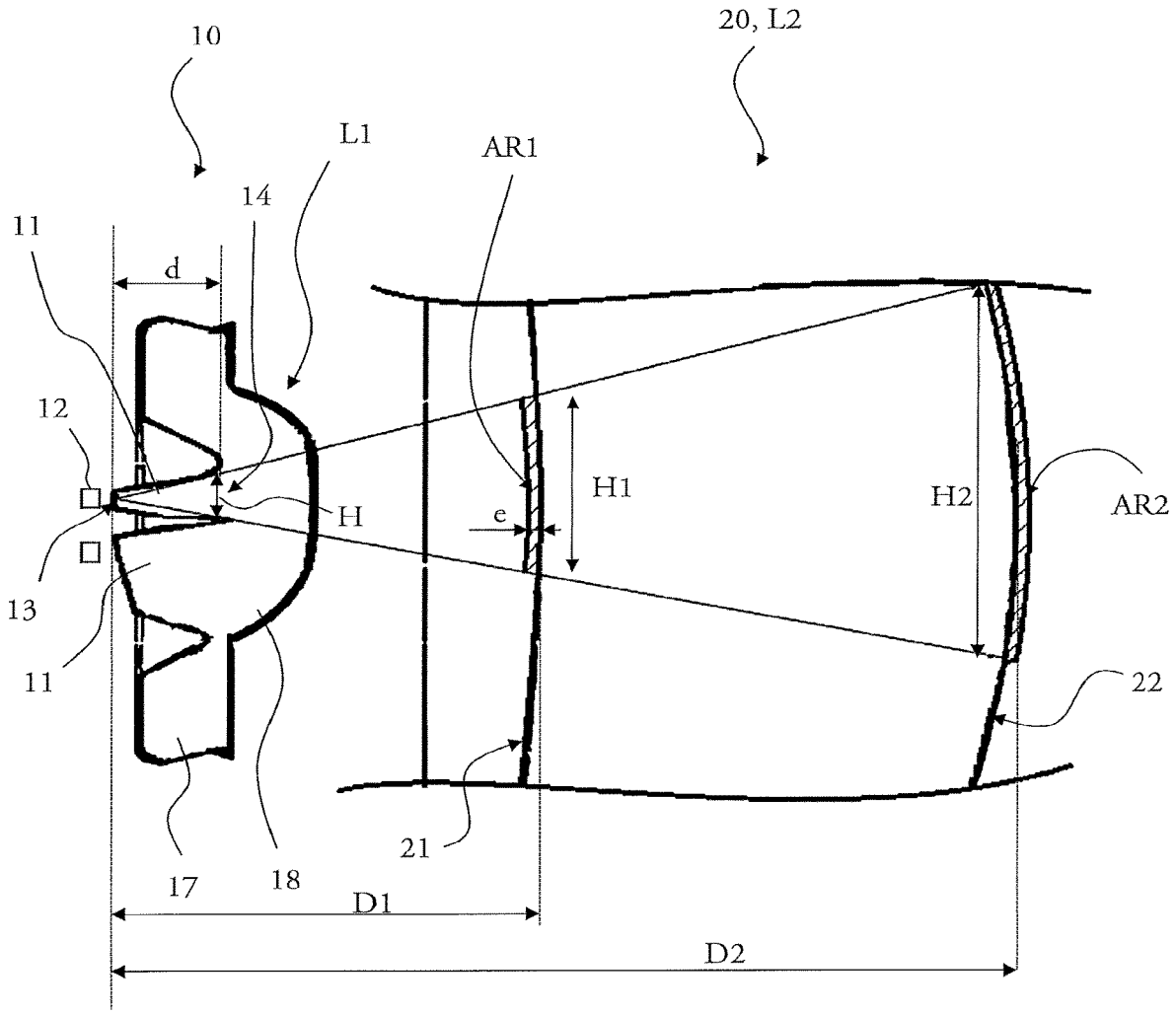
Fig. 2
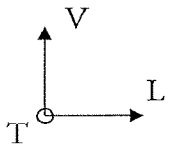

LUMINOUS MODULE INCLUDING A FIELD-CORRECTING OPTICAL ELEMENT

The invention relates to the field of luminous modules for motor vehicles, and more particularly to luminous modules able to produce a segmented light beam for the production of a matrix lighting function. It more particularly relates to a field-correcting optical lens that is integrated into a luminous module, for the emission of a matrix beam, crosswise to the light rays emitted by a matrix of primary light sources.

The technical field of the invention is that of motor-vehicle signalling or lighting devices including at least one first luminous module that is able to provide a matrix lighting function such as an adaptive driving beam (ADB).

The ADB adaptive lighting function is implemented in lighting devices via particular luminous modules and suitable detecting units that are turned towards the road scene in front of the vehicle. It is thus possible to automatically detect a road user who is liable to be dazzled by a lighting beam emitted in high-beam mode by a headlamp, and to modify the outline of this lighting beam so as to create a shadowy zone in the location in which the detected user is located while continuing to light the road far ahead on either side of the user. The advantages of the ADB function are multiple: user comfort, better visibility with respect to a low-beam lighting mode, greatly decreased risk of glare, safer driving, etc.

Luminous modules allowing this matrix lighting function to be provided are already known. They are able to emit frontwards, longitudinally, a light beam, called a "matrix beam" or even "pixel beam", composed of a plurality of elementary beams that overlap. The overall light beam projects frontwards an image of a matrix of elementary light sources. By selectively turning on or turning off each of the elementary sources, it is possible to create an overall light beam that specifically illuminates certain zones of the road in front of the vehicle, while leaving other zones in darkness.

More particularly, such a module generally includes a matrix of primary light sources, which are generally formed by light-emitting diodes (LEDs), a primary optical element including a plurality of light guides, and a projecting optic. The light guides are intended to shape the rays emitted by the light-emitting diodes into a narrower pencil light beam having the shape of a pixel, i.e. generally rectangular or square. The exit faces of the light guides form a matrix of secondary light sources that are imaged by the projecting optic.

Furthermore, in order to allow the projecting optic to be correctly focused onto the secondary elementary light sources, a field-correcting optical element may be interposed between, on the one hand, the emission plane formed by the arrangement of the exit faces of the light guides, and on the other hand, the projecting optic. Thus, all the light sources are clearly imaged by the projecting optic, thereby making it possible to optimally illuminate around other vehicles and thus to avoid dazzling other drivers. As is known, such a field-correcting optical element is formed by a lens including an entrance face of planar or convex or concave shape and an exit face of convex shape.

It will be understood that, in a module configured to produce an adaptive beam, the light-emitting diodes may be turned on independently of one another and selectively. To prevent a user of a vehicle driving in the opposite direction from being dazzled, it is conventional to project a light beam containing a dark strip. To do this, in a transverse row of light-emitting diodes of the matrix of primary light-emitting light sources, it is necessary to turn off one or more light-emitting diodes that are the immediate neighbour(s) of light-emitting diodes that remain turned on to form the rest of the beam.

Such as it was described above, the lighting module does not allow an entirely clear contrast to be obtained between the dark strip and the illuminated portions of the beam that flank it, in particular because the entrance face of the lens forming the field-correcting optical element, through which face the rays emitted by the light sources penetrate into the lens, is of concave shape. Specifically, in this configuration, the turned-on light-emitting diode emits a light ray that, after refraction at the exit face of the corresponding light guide of the primary optical element, is partially reflected from the concave entrance face of the lens and redirected in the direction of the primary optical element but with a transverse shift that directs this ray towards an exit face of a light guide neighbouring the light guide that was passed through by the light ray on the outward trip, thereby generating a problem when this neighbouring exit face corresponds to a light-emitting diode that is turned off to form the dark zone. Specifically, some of the rays redirected in the direction of the primary optical element are redirected towards the lens forming the field-correcting optical element, from a zone in which, theoretically, in order to achieve the darkest possible zone, no ray should be emitted.

The present invention aims to solve this problem by providing a field-correcting optical element including an antireflection coating on at least one segment of one of its faces with a view to decreasing parasitic rays by increasing the transmittance of incident light rays originating from a light source and to thus improve the performance of a lighting module of a motor vehicle.

One subject of the invention is more particularly a field-correcting optical element configured to be arranged in an adaptive lighting device crosswise to light rays emitted by a plurality of light sources, the optical element comprising an entrance face through which light rays enter and an exit face through which these light rays exit. According to a first aspect of the invention, at least one segment of the entrance face is covered with an antireflection coating that is able to decrease the reflection of some of the light rays by this entrance face.

It will be understood that the decrease in the parasitic reflection of these rays allows the redirection of light rays towards the light sources to be avoided, and thus the precision, in the emission of the light rays, required to produce an adaptive lighting function to be preserved. This decrease in the reflection of parasitic rays may in particular be measured by measuring the transmittance of the light rays through the optical element.

According to various features of the invention, which may be implemented alone or in combination, provision may be made for:

- the entrance face of the light rays to be concave; it will be understood that here the concavity, and later on the convexity, of an exit or entrance face is defined with respect to the correcting optical element itself, i.e. with respect to the centre thereof; in other words, the entrance face of the correcting optical element is concave in that it has a profile that curves towards the interior of the correcting optical element: the central portion of the entrance face, i.e. the portion centred on the optical axis of the correcting optical element, is thus more towards the interior of this correcting optical element than the edges of this entrance face;

the dioptric interface formed between the entrance face and its antireflection coating is configured to have, for a normal incidence, a transmittance at least equal to 97%.

According to a second aspect of the invention, at least one segment of the exit face is covered with an antireflection coating that is able to decrease the reflection of some of the light rays by this exit face.

The exit face for light rays may be convex; in accordance with the above, it will be understood that the exit face of the correcting optical element is convex in that it has a profile that curves towards the exterior of the correcting optical element: the central portion of the exit face, i.e. the portion centred on the optical axis of the correcting optical element, is thus more towards the exterior of this correcting optical element than the edges of this exit face.

In a first embodiment, the antireflection coating of at least one segment of the entrance face of the field-correcting optical element according to the invention advantageously includes any one at least of the following features, which may be implemented alone or in combination:

the antireflection coating is a monolayer coating of low-refractive-index material, preferably magnesium fluoride $MgF_2$;

the monolayer of said low-refractive-index material has a thickness equal to $\lambda/4 \cdot n$, where $\lambda$ is the wavelength of the centrepoint of the antireflection and n the refractive index of said material.

the monolayer of said low-refractive-index material, preferably magnesium fluoride $MgF_2$, has a thickness of 101 nm for a refractive index n=1.36 at a wavelength of 550 nm.

In a second embodiment, the antireflection coating of at least one segment of the entrance face of the field-correcting optical element according to the invention advantageously includes any one at least of the following features, which may be implemented alone or in combination:

the antireflection coating is a hybrid monolayer coating in which are dispersed a plurality of hybrid particles each including at least two elements of different natures and refractive indices; preferably, each hybrid particle consists of a first element of refractive index n1 surrounded by a second element of refractive index n2 forming a coating layer;

the first and second elements of a hybrid particle may be of polymer and/or inorganic and/or organic nature; preferably the first element is made of at least one mineral alkoxide employed alone or in a mixture and preferably of an alkoxysilane that possibly has up to four hydrolysable groups.

In a third embodiment, the antireflection coating of at least one segment of the entrance face of the field-correcting optical element according to the invention advantageously includes any one at least of the following features, which may be implemented alone or in combination:

the antireflection coating is a multilayer coating of at least two layers of different refractive indices;

the multilayer coating is composed of an alternation of at least one layer of a high-refractive-index material and of at least one layer of a low-refractive-index material; the thickness of a layer depends on the refractive index for a selective wavelength;

the low-refractive-index material is chosen from materials having a refractive index lower than 1.6 for a wavelength of 550 nm;

the low-refractive-index material is chosen from $SiO_2$, $MgF_2$, LiF, $CaF_2$, NaF, $ZrF_4$, $AlF_3$, $Na_5Al_3F_{14}$ and $Na_3AlF_6$ employed alone or in a mixture;

the high-refractive-index material is chosen from materials having a refractive index higher than 1.7 for a wavelength of 550 nm;

the high-refractive-index material is chosen from $ZrO_2$, $TiO_2$, $Ta_2O_5$, $Na_2O_5$, $SnO_2$, ZnO, ZnS, $HfO_2$, $Pr_2O_3$, $PrTiO_3$, $La_2O_3$, $Dy_2O_5$, $In_2O_3$, $Nb_2O_5$, $Yb_2O_3$, $Si_3N_4$ and AlN employed alone or in a mixture.

Another subject of the invention is a process for manufacturing a field-correcting optical element according to the invention, i.e. which comprises a concave entrance face and a convex exit face for light rays emitted by a plurality of light sources, and which is configured to be arranged in an adaptive luminous device. The process includes at least one step of applying an antireflection coating to at least one segment of at least one face of the field-correcting optical element, preferably the concave entrance face. Thus, said face, which forms a polycarbonate- or glass-based transparent substrate, is provided with antireflection properties with a view to increasing the transmittance of the light rays for specific wavelengths.

According to various features, which may be implemented alone or in combination, provision may be made for:

the applying step to consist in depositing at least one antireflection-coating layer using a vacuum process, preferably physical vapour deposition;

the applying step to consist in depositing an antireflection coating forming a monolayer, such as described above, the monolayer being made of a low-refractive-index material and having a thickness lower than 1 micron, and preferably being a monolayer of $MgF_2$ of a thickness of 101 nm with a refractive index of 1.36 at 550 nm;

the applying step to consist in successively depositing an alternation of at least two layers of different refractive indices so as to form a multilayer antireflection coating.

According to other features, which may be implemented alone or in combination, provision may be made for:

the applying step to consist in depositing at least one antireflection-coating layer using a sol-gel process and a wet deposition technique implemented at atmospheric pressure and room temperature, possibly dip coating or spin coating or spray coating or even laminar-flow coating;

the monolayer obtained after immersion in the sol-gel solution to form a hybrid monolayer, such as described above, in which are dispersed hybrid particles each including at least two elements of different natures and refractive indices;

the applying step to consist in depositing an antireflection coating monolayer using the dip-coating deposition technique, including a step of submerging the substrate in a sol-gel solution followed by a drying or heat treatment;

each hybrid particle to consist of a first element of refractive index n1 surrounded by a second element of refractive index n2 forming a coating layer;

the first and second elements to possibly be of polymer and/or inorganic and/or organic nature;

the hybrid monolayer to have a thickness comprised between 10 nanometres and 10 microns, depending on the refractive index and the centrepoint of the antireflection; in particular, the hybrid monolayer may, depending on the material, for a refractive index ranging from 1.32 to 1.36, have a thickness of 101 nanometres and an antireflection centrepoint of 550 nm;

the sol-gel process to be based on a first step of hydrolysis of at least one mineral alkoxide that is used alone or in a mixture, said alkoxide preferably being an alkoxysilane that possibly has up to four hydrolysable groups, and more preferably being a tetraalkoxysilane, for example tetramethoxysilane (TMOS) or tetraethoxysilane (TEOS), or a titanium alkoxide, for example titanium isopropoxide, or indeed even a zinc alkoxide, for example zinc isopropoxide, followed by a condensing second step;

the at least one mineral alkoxide to be an alkoxysilane that is mixed with at least one monomer that is cross-linkable under UV or under the effect of a heat treatment, preferably compounds bearing methacrylate groups, epoxy acrylate groups, or vinyl ether groups, so as to obtain an additional curing effect;

the mixture obtained to possibly furthermore include a surfactant, preferably a polyoxyethylene-containing surfactant.

Another subject of the invention is a motor-vehicle luminous module including a field-correcting optical element such as was presented above.

such a luminous module may furthermore include:

primary light sources that are configured to emit light rays from a common substrate, the substrate possibly for example being planar and orthogonal to the optical axis of the luminous module;

a primary optical element that includes a front segment forming a lens and a back segment that includes a plurality of light guides, each light guide including an entrance face through which light rays emitted by a primary light source enter and an exit face through which these light rays exit in the direction of the front segment forming said lens, these exit faces possibly in particular being coincident with a central portion of the front segment forming a lens; and a projecting optic that is able to project an image of the exit faces of the light guides in order to form an overall adaptive light beam, the field-correcting optical element being arranged on the optical axis of the luminous module between the primary optical element and the projecting optic, that entrance face of this field-correcting optical element which is at least partially covered with an antireflection coating being turned towards the primary optical element.

According to various features of the luminous module of the invention, which may be implemented alone or in combination, provision may be made for:

the primary light sources to be arranged in a matrix, which mainly lies in a plane that is orthogonal to the longitudinal direction of the optical axis (A), and which has at least one transverse row of a plurality of light-emitting diodes borne by the front face of a printed circuit board;

each light-emitting diode to be controlled individually; the matrix of primary elementary light sources may then be configured so as to include a series of turned-off light-emitting diodes adjacent to a series of turned-on light-emitting diodes, with a view to obtaining a final light beam the outline of which is modified by a dark strip;

that segment of a face of the field-correcting optical element which is covered with an antireflection coating to extend over a height, in a first direction perpendicular to the optical axis of said optical element, that depends on the distance between the entrance face of a light guide and the face of this optical element, on the length of said light guide, and on the height of the light guide at its exit face in the first direction, according to the formula:

$$(H1,H2)=(D1,D2)*H/d$$

Another subject of the invention is a motor-vehicle equipped with a lighting device that is able to produce an "ADB" adaptive lighting function, characterized in that it includes a field-correcting optical element such as described above.

Other features and advantages of the invention will become more clearly apparent on reading the detailed description of embodiments of the invention, which is given below by way of nonlimiting illustrative example and with reference to the appended figures, in which:

FIG. 1 is a cross-sectional view, in a cross-sectional plane comprising the longitudinal optical axis (A) of the projecting optic, of a luminous module that is able to provide an "ADB" adaptive high-beam function in a motor-vehicle signalling or lighting device, the luminous module including a field-correcting optical lens L2 according to the invention; and FIG. 2 is a detail view in vertical transverse cross section along a longitudinal orientation "L" of the longitudinal optical axis (A) of a field-correcting optical lens L2 according to the invention, said lens configured to be arranged in a pixelated optical system including a plurality of light guides.

It will firstly be noted that although the figures illustrate the invention in a detailed way with regard to implementation thereof, they may of course serve to better define the invention where appropriate. Likewise, it will be recalled that, in all the figures, elements that are the same have been referenced with the same references. It will also be understood that the embodiments of the invention that are illustrated in the figures are given by way of nonlimiting example.

It will also be recalled that, in the following description, the term "front" refers to the direction of the final light beam emitted longitudinally frontwards, i.e. as output from the luminous module according to the invention.

The invention has an application in a motor vehicle equipped with a lighting device that is able to produce an "ADB" adaptive lighting function. This lighting device in particular includes a luminous module such as will be described with reference to FIG. 1, and wherein it is noteworthy that a field-correcting optical element is at least partially covered with an antireflection coating.

FIG. 1 illustrates a luminous module 1 equipped with a field-correcting optical element 20 according to the invention, and more particularly in a case where the field-correcting optical element is formed by a lens L2.

The luminous module 1 has a longitudinal optical axis (A) and it is configured to emit an adaptive final light beam longitudinally frontwards in order to provide what is called an "ADB" adaptive high-beam function in a motor-vehicle signalling or lighting device.

Along the longitudinal direction "L" of the optical axis, the module includes, from back to front, a matrix 16 of primary light sources that are here formed by light-emitting diodes each of which is able to emit a primary elementary beam from a common emission plane that is orthogonal to the optical axis, then a primary optical element 10 that is arranged following the matrix 16 of light-emitting diodes 12 in order to modify the distribution of the emitted light rays, then the field-correcting optical element 20 and a projecting optic 30, the field-correcting optical element being intended to correct the path of the rays output from the primary optical element to the projecting optic 30 in order to achieve a clear projection to infinity of the whole of the adaptive final light beam.

The matrix 16, which lies in a plane that is orthogonal to the longitudinal direction "L", is here equipped with two transverse rows of 17 light-emitting diodes 12 that are borne by the front face of a printed circuit board 15 and that are arranged one above the other, as may be seen in FIG. 2. Each light-emitting diode 12 may be controlled individually via control electronics and the printed circuit board 15. With a view to creating an adaptive beam, i.e. an overall light beam including a dark zone therein, each transverse row of light-emitting diodes 12 may be controlled to form at least one set of successive turned-on diodes and at least one or at least one set of successive turned-off diodes.

The primary optical element 10 here includes a back first segment 17, which is formed from a plurality of light guides 11 and which is turned towards the matrix 16 of primary light sources, and a front second segment 18 for shaping the light beams emitted by the secondary light sources, so as to form a lens L1.

In the back first segment 17 of the primary optical element, one light guide 11 is placed facing each light-emitting diode 12, so that, in the illustrated embodiment, two rows of light guides are arranged one above the other, though it will be understood that, without departing from the context of the invention, there could be a different number of rows and for example a single row of diodes and of light guides, or a system comprising three rows. Each light guide 11 extends along a longitudinal principal axis from an entrance face 13, which is placed facing the corresponding light-emitting diode 12 so that most of the light rays emitted by each diode 12 enters into the associated light guide 11, and passes to a front end face, or exit face 14 for the light rays. Each light guide 11 is designed to guide, via successive internal reflections, the rays entering via the entrance face 13 to the exit face 14.

The light exiting via the exit face 14 emerges into the front second segment 18, which forms a lens L1 for shaping the light rays in order to direct them towards the projecting optic 30 via the field-correcting optical element 20. The lens L1 formed by the front second segment 18 is here placed in the direct extension of the light guides 11, the latter and the front second segment 18 being integrally formed and made of the same material in order to form a single-piece primary optical element. As a result, the shape of the light rays which is imparted by the exit face 14 of a light guide generates a secondary light source. In the illustrated example, the exit faces 14 of the light guides form a matrix of two rows each of 17 secondary light sources.

The field-correcting optical element 20 here has the shape of a lens comprising an entrance face 21 through which the light rays emitted by each diode enter, which face is placed facing the primary optical element 10 and which is concave, and an exit face 22 through which these corrected rays exit, which face is placed facing the projecting optic 30 and which is convex.

According to the invention, at least one segment of one of the faces 21, 22 of the lens L2, i.e. the concave entrance face and the convex exit face, respectively, is covered with an antireflection coating AR1, AR2 that is able to increase the transmittance of incident light rays coming from the lens L1 of the primary optical element 10 and that are initially emitted by the turned-on light-emitting diodes 12.

The field-correcting optical element and the antireflection coating that is provided to at least partially cover this field-correcting optical element, and in particular its entrance face, through which the rays emitted by the light sources penetrate into the field-correcting optical element, will now be described in more detail.

FIG. 2 illustrates in cross section a portion of the primary optical element 10, allowing two light guides, which are arranged one above the other so as to face two light-emitting diodes, which are shown schematically, and a portion of a lens L2 forming the field-correcting optical element 20 according to the invention, to be seen.

In the illustrated example, a first antireflection-coating layer AR1 has been partially deposited on the entrance face 21 through which the rays enter, and a second antireflection-coating layer AR2 has been partially deposited on the exit face 22 through which the incident light rays exit, and it will be understood that the thickness of these coating layers has here been exaggerated in order to allow them to be seen in the figure.

Such as may have been specified above, each of these coating layers has the effect of increasing the transmittance of at least one incident light ray. Thus, the amount of light rays liable to be reflected by the entrance face 21 of the rays in the direction of the primary optical element with a transverse shift such that the ray issued from a secondary light source passes, on return, into the zone dedicated to a neighbouring secondary light source, and therefore the amount of light rays liable to decrease the clearness of the dark zone formed by the turned-off light sources, is decreased.

It will be understood that the definition of an antireflection-coating zone AR1, AR2 on at least one face 21, 22 of the lens L2 forming the field-correcting element is dependent on the arrangement of the primary optical element 10 and more particularly of at least one light guide 11 including an entrance face 13 that is positioned longitudinally directly opposite and in proximity to an associated light-emitting diode 12 and an exit face 14 that forms a secondary light source. In particular, the minimum area (S) of the segment of a face 21, 22 of this lens L2 that is covered by an antireflection coating AR1, AR2 depends on the distance (D) between the entrance face 13 of a light guide 11 and the face 21, 22 in question of the lens L2, on the length (d) of said light guide 11, i.e. its longitudinal dimension between the entrance face 13 and the exit face 14, and on the vertical or transverse dimension of the exit face 14, in the dimension of the minimum coating area that it is desired to define.

By way of example, in FIG. 2, the dimensions to be taken into account to define the height H1 and the height H2, i.e. the dimension in a first direction perpendicular to the optical axis, and here the vertical dimension, defined by the coordinate system shown in FIG. 2, of the antireflection-coating zones AR1, AR2, have been illustrated. Such as described above, the distance (D) between the entrance face of the light guide and the face to be coated, and the length (d) of the light guide are used to calculate them using the formulae:

$$H1=D1*H/d$$

$$H2=D2*H/d,$$

where H is the height, i.e. the dimension aligned with the vertical dimension, of the exit face 14 of the light guide 11 in question.

It is necessary that the antireflection coating be placed so as to cover one and/or the other of the faces of the lens L2 forming the field-correcting optical element, at least over this height H1, H2. It will thus be possible to use a minimum amount of antireflection coating and to limit the cost of obtaining the final product. Of course, if the process used to produce the coverage is made easier when the corresponding face is completely covered, it is advantageous not to seek to limit the coverage to its strict minimum.

According to the invention, at least one face of the field-correcting optical element 20, and more particularly at least the concave entrance face 21 directly facing the primary optical element 10, includes an antireflection coating. Provision will possibly be made for a single antireflection-coating zone AR1 to cover at least one segment of this concave entrance face 21.

According to one preferred embodiment of the invention, the antireflection coatings, AR1 and AR2, cover at least one segment of the concave entrance face 21 and at least one segment of the convex exit face 22 of the field-correcting optical lens L2, respectively.

The presence of this at least one antireflection-coating layer allows a transmittance of light rays through a dioptric interface of the lens L2 forming the field-correcting optical element that is comprised between 97% and 99% to be obtained. The increase in this transmittance, measured at normal incidence, with respect to a standard transmittance of 95%, measured in an equivalent way for a dioptric interface made of polycarbonate, allows the amount of rays that are redirected towards the primary optical element and that may thus decrease the clearness of the contrast between the dark zone and the light zone of the projected overall light beam, to be drastically decreased.

The type of antireflection coating used on one and/or the other of the faces of the lens L2 forming the field-correcting optical element will now be described in more detail. It should be noted that the material used in the antireflection coating must be transparent in the range of wavelengths employed by the light sources.

The antireflection coating of the faces of the lens L2 may be a multilayer or monolayer coating.

In the case of a monolayer antireflection coating AR, the low-refractive-index material used may in particular consist of a magnesium fluoride monolayer $MgF_2$ of a minimum thickness (e) of 101 nm for a refractive index n=1.36 centred on a wavelength of 550 nm. If it is desired to modify the centrepoint of the filter for a known refractive index, it is enough to change the thickness of the deposited layer. A contrario, the modification of the thickness of the coating may allow the centrepoint of the antireflection to be shifted: increasing the thickness leads to a shift in the centrepoint towards the red, and decreasing this thickness shifts this centrepoint towards the blue.

It is also possible, by way of example, to provide a hybrid monolayer within which are dispersed a plurality of hybrid particles each including at least two elements of different natures and refractive indices. In this case, each hybrid particle consists of a first element of refractive index n1 surrounded by a second element of refractive index n2 forming a coating layer, the first and second elements possibly being of polymer and/or inorganic and/or organic nature. Preferably, the first element is made of at least one mineral alkoxide.

In the case of a multilayer antireflection coating, a coating consisting of at least two layers of different refractive indices and in which the thickness of a layer depends on the refractive index will possibly be preferred. Preferably, the multilayer coating is composed of an alternation of at least one layer of a high-refractive-index material and of at least one layer of a low-refractive-index material.

Among low-refractive-index materials, materials having a refractive index lower than 1.6 at a wavelength of 550 nm, such as $SiO_2$, $MgF_2$, LiF, $CaF_2$, NaF, $ZrF_4$, $AlF_3$, $Na_5Al_3F_{14}$ and $Na_3AlF_6$, employed alone or in a mixture, will be preferred. Among high-refractive-index materials, materials having a refractive index higher than 1.7 at a wavelength of 550 nm, such as $ZrO_2$, $TiO_2$, $Ta_2O_5$, $Na_2O_5$, $SnO_2$, ZnO, ZnS, $HfO_2$, $Pr_2O_3$, $PrTiO_3$, $La_2O_3$, $Dy_2O_5$, $In_2O_3$, $Nb_2O_5$, $Yb_2O_3$, $Si_3N_4$ and AlN, employed alone or in a mixture, will be preferred.

It will be understood that the nature (monolayer, multilayer) and composition (choice of the material that is transparent in the visible domain) of the antireflection coating may in particular depend on the deposition technique employed to carry out the surface treatment on the substrate formed by at least one face 21, 22 of the field-correcting optical lens L2.

The process for manufacturing a lens L2 forming the field-correcting optical element according to the invention, which includes at least one step of applying an antireflection coating AR, will now be described.

In a first embodiment of this process, the applying step consists in depositing at least one antireflection-coating layer AR using a vacuum process, preferably a physical vapour deposition (PVD) based on an evaporating method consisting in heating the antireflection-coating material so that it evaporates in the direction of the substrate and condenses on its surface to form the desired layer.

In the case of a monolayer antireflection coating AR obtained in a PVD operation, a low-refractive-index material, preferably magnesium fluoride $MgF_2$ (refractive index 1.36), is deposited in a vacuum chamber in which the pressure is about $10^{-4}$ mbar. By thermal evaporation in the vacuum chamber, what is meant is that the material, placed in a molybdenum crucible, is heated, via a tungsten filament, until its evaporation temperature is reached. The material then deposits on the substrate, here the entrance face and/or exit face of the lens L2, in a single layer. The thickness of the layer is continuously measured via a quartz balance so as to stop the deposition when the thickness required to obtain a monolayer antireflection effect centred on the desired wavelength is reached. By way of example, the antireflection coating may be a monolayer of $MgF_2$ centred on 550 nm. The minimum reflection being achieved at a quarter wavelength, the required thickness value is 101 nm with a refractive index of 1.36 at 550 nm.

The same type of process may be used in the case of a multilayer antireflection coating, the various materials used being evaporated in succession, provided that a layer of sufficient thickness is obtained.

In a second embodiment of this process, the applying step consists in depositing at least one antireflection-coating layer AR using a so-called sol-gel process and a wet deposition technique implemented at atmospheric pressure and at room temperature, which technique may be a dip-coating deposition technique, a spin-coating deposition technique, a spray-coating deposition technique or even a laminar-flow coating technique.

The dip-coating deposition technique, which consists in submerging the lens forming the field-correcting optical element in the sol-gel solution, then in removing this substrate at constant speed, will in particular possibly be preferred. This technique has the advantage of simultaneously depositing a coating layer on each face 21, 22 of the lens L2 forming the substrate. This dip-coating deposition technique allows a hybrid antireflection-coating monolayer to be obtained, the thickness of which may be varied depending on the centrepoint desired for the antireflection. In particular, if the obtained hybrid monolayer has a refractive index comprised between 1.32 and 1.36, its thickness, for a centrepoint of 550 nm, may be comprised between 101 and 110 nm. More generally, provision will possibly be made, by way of example, for a coating thickness comprised between 10 nanometres and 10 microns.

In one preferred embodiment of the invention, the dip-coating depositing step is carried out at a room temperature of 20 to 25° C., under a relative humidity of 30 to 60% at 22° C. Under these conditions, the recommended speed of removal is 1.6 mm/s. Advantageously, the substrate covered with the antireflection coating is placed, after the gelification, in an oven in order to receive a drying heat treatment, preferably at 90° C. for 2 hours.

The application of an antireflection coating AR to at least one face of the lens L2 forming the field-correcting optical element has the effect of decreasing the amount of light not transmitted by at least half for a given wavelength of 450 nm and/or 550 nm.

The above description clearly explains how the invention makes it possible to achieve the objectives that were set therefor and in particular to provide a field-correcting optical lens in a luminous module configured to form an adaptive beam, and in particular a lens the concavity of the face of which being arranged facing the light sources creates a problem with the redirection of rays emitted by a zone corresponding to turned-on light sources towards a zone corresponding to turned-off light sources, which is covered with an antireflection coating.

Such as was possibly mentioned above, variants are possible and the invention is not limited to the embodiments specifically given in this document by way of nonlimiting example, and encompasses in particular any equivalent means and any technically employable combination of these means.

The invention claimed is:

1. A motor-vehicle luminous module comprising:

primary light sources that are configured to emit light rays from a common emission plane that is orthogonal to an optical axis of the luminous module;

a primary optical element that includes a front segment forming a lens and a back segment that includes a plurality of light guides, each light guide including an entrance face through which light rays emitted by a primary light source enter and an exit face through which these light rays exit in the direction of the front segment forming said lens; and a projecting optic that is able to project an image of the exit faces in order to form an overall adaptive light beam, a field-correcting optical element being arranged on the optical axis of the luminous module between the primary optical element and the projecting optic, the entrance face, which is at least partially covered with an antireflection coating, being turned towards the primary optical element, the field-correcting optical element including an entrance face through which light rays enter, and an exit face through which these light rays exit, wherein at least one segment of the entrance face is covered with an antireflection coating that is able to decrease the reflection of some of the light rays by this entrance face.

2. The motor-vehicle luminous module according to claim 1, wherein a dioptric interface formed between the entrance face of the field-correcting optical element and its antireflection coating is configured to have a transmittance at least equal to 97%.

3. The motor-vehicle luminous module according to claim 1, wherein at least one segment of the exit face of the field-correcting optical element is covered with an antireflection coating.

4. The motor-vehicle luminous module according to claim 1, wherein the antireflection coating is a monolayer coating of low-refractive-index material, preferably magnesium fluoride $MgF_2$.

5. The motor-vehicle luminous module according to claim 1, wherein the antireflection coating has a thickness of 101 nm.

* * * * *